US011123853B2

(12) United States Patent
Hammerstingl et al.

(10) Patent No.: US 11,123,853 B2
(45) Date of Patent: Sep. 21, 2021

(54) HAND-HELD POWER TOOL

(71) Applicant: Hilti Aktiengesellschaft, Schaan (LI)

(72) Inventors: Stefan Hammerstingl, Munich (DE); Eduard Pfeiffer, Halblech (DE); Matthias Doberenz, Untermeitingen (DE); Pierre Pallmer, Igling (DE)

(73) Assignee: Hilti Aktiengesellschaft, Schaan (LI)

( * ) Notice: Subject to any disclaimer, the term of this patent is extended or adjusted under 35 U.S.C. 154(b) by 52 days.

(21) Appl. No.: 16/324,233

(22) PCT Filed: Jul. 31, 2017

(86) PCT No.: PCT/EP2017/069309
§ 371 (c)(1),
(2) Date: Feb. 8, 2019

(87) PCT Pub. No.: WO2018/029025
PCT Pub. Date: Feb. 15, 2018

(65) Prior Publication Data

US 2019/0168369 A1 Jun. 6, 2019

(30) Foreign Application Priority Data

Aug. 9, 2016 (EP) ..... 16183369

(51) Int. Cl.
*B25D 11/00* (2006.01)
*B25D 17/06* (2006.01)
*B25D 16/00* (2006.01)

(52) U.S. Cl.
CPC ..... *B25D 11/005* (2013.01); *B25D 17/06* (2013.01); *B25D 16/00* (2013.01);
(Continued)

(58) Field of Classification Search
CPC ..... B25D 11/005; B25D 17/06; B25D 16/00; B25D 2217/0019; B25D 2217/0023; B25D 2250/035
See application file for complete search history.

(56) References Cited

U.S. PATENT DOCUMENTS 3,245,483 A * 4/1966 Etzkorn ..... B25D 17/08 173/137
4,349,074 A * 9/1982 Ince ..... B25D 9/08 173/48

(Continued)

FOREIGN PATENT DOCUMENTS

| | | |
|---|---|---|
| EP | 0759341 | 2/1997 |
| EP | 2514569 | 10/2012 |
| EP | 2669060 | 12/2013 |

OTHER PUBLICATIONS

International Search Report of PCT/EP2017/069309, dated Jun. 10, 2017.

*Primary Examiner* — Nathaniel C Chukwurah
*Assistant Examiner* — Lucas E. A. Palmer
(74) *Attorney, Agent, or Firm* — Davidson, Davidson & Kappel, LLC

(57) ABSTRACT

The A hand-held power tool includes a tool holder 2 for holding a tool and a pneumatic striking mechanism for periodically generating impacts on the tool held in the tool holder. The striking mechanism includes a guiding tube, an exciter piston, a striker, a pneumatic chamber closed by the exciter piston and the striker in the guiding tube, and a compensating opening in the guiding tube for ventilating the pneumatic chamber. A cap covers the compensating opening on an outside of the guiding tube. The cap is open in an opening direction which is largely tangential to the guiding tube.

22 Claims, 1 Drawing Sheet

(52) U.S. Cl.
CPC ..... *B25D 2217/0019* (2013.01); *B25D 2217/0023* (2013.01); *B25D 2250/035* (2013.01)

(56) References Cited

U.S. PATENT DOCUMENTS

| | | | | | |
|---|---|---|---|---|---|
| 5,088,566 | A * | 2/1992 | Gustafsson | B25D 11/125 | 173/200 |
| 5,435,397 | A * | 7/1995 | Demuth | B25D 11/005 | 173/109 |
| 6,523,622 | B1 * | 2/2003 | Berger | B25D 11/005 | 173/131 |
| 9,527,199 | B2 * | 12/2016 | Massler | B25D 17/06 | |
| 9,969,072 | B2 * | 5/2018 | Fuenfer | B21C 37/0815 | |
| 2003/0132015 | A1 * | 7/2003 | Meixner | B25D 11/005 | 173/48 |
| 2004/0177981 | A1 * | 9/2004 | Berger | B25D 11/005 | 173/201 |
| 2007/0284126 | A1 * | 12/2007 | Kirsch | B25D 17/245 | 173/212 |
| 2008/0296034 | A1 * | 12/2008 | Braun | B25D 17/06 | 173/4 |
| 2010/0163260 | A1 * | 7/2010 | Berger | B25D 17/043 | 173/13 |
| 2010/0300718 | A1 * | 12/2010 | Hartmann | B25D 11/125 | 173/201 |
| 2011/0303429 | A1 * | 12/2011 | Kohlschmied | B25D 11/005 | 173/112 |
| 2013/0284473 | A1 * | 10/2013 | Hartmann | B25D 11/125 | 173/1 |
| 2013/0319712 | A1 | 12/2013 | Massler et al. | | |

* cited by examiner

HAND-HELD POWER TOOL

FIELD OF THE INVENTION

The present invention relates to a hand-held power tool, which includes an electropneumatic striking mechanism.

A hammer drill which includes a pneumatic striking mechanism is known from EP 0 759 341 A2. The striking mechanism includes a guiding tube, in which an exciter piston driven by a motor and a striker close a pneumatic chamber. The striker follows the movement of the exciter, coupled by the pneumatic chamber. The guiding tube is provided with multiple openings for ventilating the pneumatic chamber. One opening is used to compensate for losses of the pneumatic chamber, other openings are used to automatically stop the striker during idle strikes.

SUMMARY OF THE INVENTION

The hand-held power tool according to the present invention includes a tool holder for holding a tool and a pneumatic striking mechanism for periodically generating impacts on the tool held in the tool holder. The striking mechanism includes a guiding tube, an exciter piston, a striker, a pneumatic chamber closed by the exciter piston and the striker in the guiding tube, and a compensating opening in the guiding tube for ventilating the pneumatic chamber. A cap covers the compensating opening on an outside of the guiding tube. The cap is open in an opening direction which is largely tangential to the guiding tube, i.e. parallel to a longitudinal axis of the guiding tube.

The cap guides an air flow from the pneumatic chamber in a defined manner in a direction essentially in parallel to the guiding tube. The guiding tube is surrounded by other assemblies of the hand-held power tool which influence the air flow. An air flow flowing out of the guiding tube in the radial direction strikes one of the assemblies a short distance from the guiding tube. The air flow and particles carried along thereby may impair the other assemblies and conversely the assembly may have a negative effect on the flow behavior. Due to the assemblies, which are typically telescopically arranged one inside the other, the air flow may move unhindered along the guiding tube over comparatively long distances. As a result, they influence each other less.

One embodiment provides that the cap is formed by a bulge of the guiding tube. The cap, integrally formed with the guiding tube, does not have any seams, resulting in an undefined swirl of the air flow. An underside of the cap facing the pneumatic chamber preferably transitions seamlessly into an inner surface of the guiding tube.

One embodiment provides that the cap is open due to a recess which is largely tangential to the guiding tube. The largely tangential recess has an inclination of a maximum of 45 degrees with respect to the guiding tube, i.e., the tangential component of its direction is greater than the radial component. The recess defines the opening direction.

One embodiment provides that the cap has exactly one recess. A branching of the air flow may result in a swirl and undefined flow properties.

One embodiment provides a carrier tube, in which the guiding tube is situated. The cap is situated in a channel formed between the carrier tube and the guiding tube.

BRIEF DESCRIPTION OF THE FIGURES

The following description explains the present invention based on exemplary specific embodiments and figures.

Unless otherwise indicated, identical or functionally equivalent elements are indicated by identical reference numerals in the figures.

DETAILED DESCRIPTION OF THE INVENTION

Figure 1:
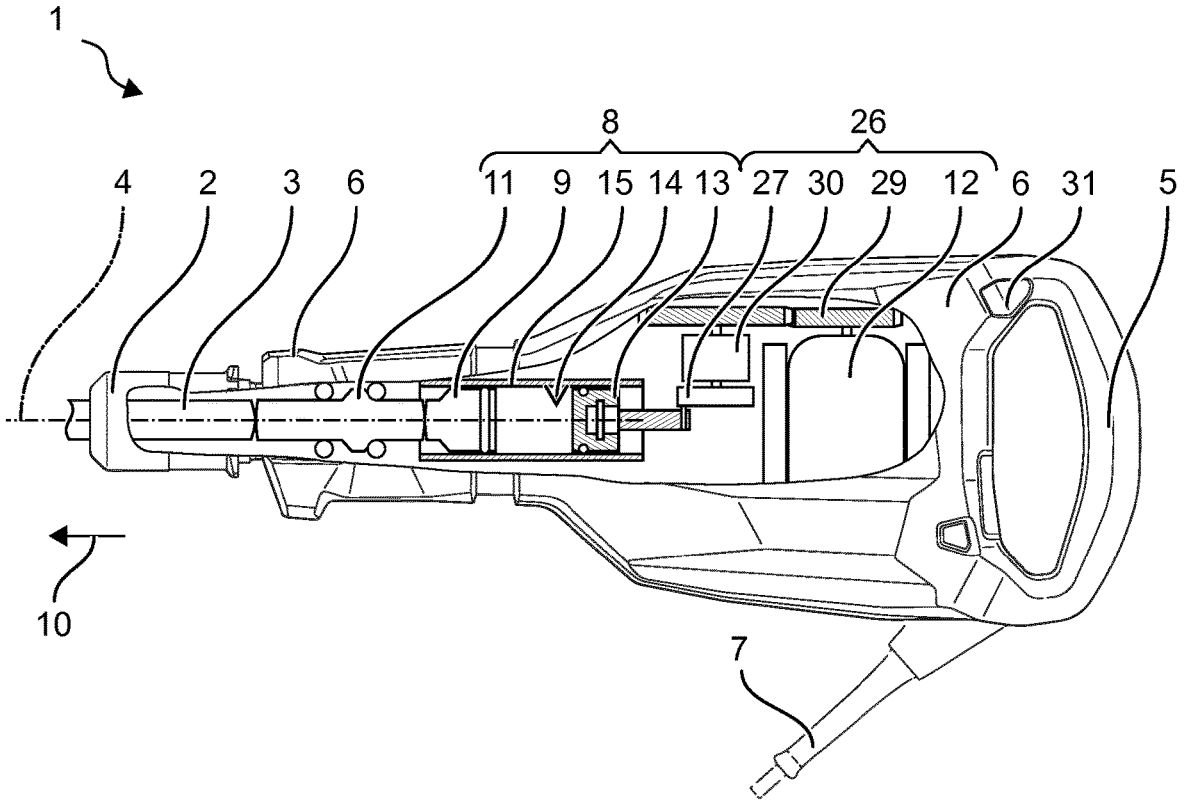
FIG. 1 shows a hammer drill.

FIG. 1 schematically shows an electric hammer 1 as an example of a hand-guided, chiseling power tool. Electric hammer 1 includes a tool holder 2, into which a chisel 3 or another tool may be inserted and locked along a working axis 4. Electric hammer 1 includes a handle 5, which is typically fastened on an end of a power tool housing 6 of electric hammer 1 facing away from tool holder 2. An additional handle may be fastened, for example, near tool holder 2. The user may guide and hold electric hammer 1 by handles 5 during chiseling. A power supply may take place via a battery or a power cord 7.

Electric hammer 1 includes a pneumatic striking mechanism 8 having a striker 9, which periodically applies impacts to chisel 3 in impact direction 10 during operation. Striker 9 is movably guided on working axis 4. In one embodiment, striker 9 may strike chisel 3 directly. In the illustrated embodiment, striker 9 strikes an anvil 11, which transfers the impact to chisel 3 supported in tool holder 2. Anvil 11 is situated between striker 9 and tool holder 2 in impact direction 10 of striker 9.

Pneumatic striking mechanism 8 is driven by an electric motor 12. Electric motor 12 moves an exciter piston 13 periodically back and forth on working axis 4. Exciter piston 13 and striker 9 close a pneumatic chamber 14 along working axis 4. Pneumatic chamber 14 forms an air spring, which couples the movement of striker 9 to the movement of exciter piston 13. The effect of the air spring is based on the compression of the air in pneumatic chamber 14 and the resulting pressure difference from the surroundings outside pneumatic chamber 14.

Striking mechanism 8 includes a guiding tube 15, in which exciter piston 13 is guided along working axis 4. Guiding tube 15 has a preferably cylindrical inner surface 16, which runs in parallel to working axis 4. Exciter piston 13 rests flush against inner surface 16. The cross sectional profile of exciter piston 13 corresponds to the hollow profile of guiding tube 15. Exciter piston 13 closes guiding tube 15 air-tight against impact direction 10. Striker 9 also rests flush against inner surface 16. Guiding tube 15 closes pneumatic chamber 14, which is enclosed between striker 9 and exciter piston 13 along working axis 4, in the radial direction.

Figure 2:
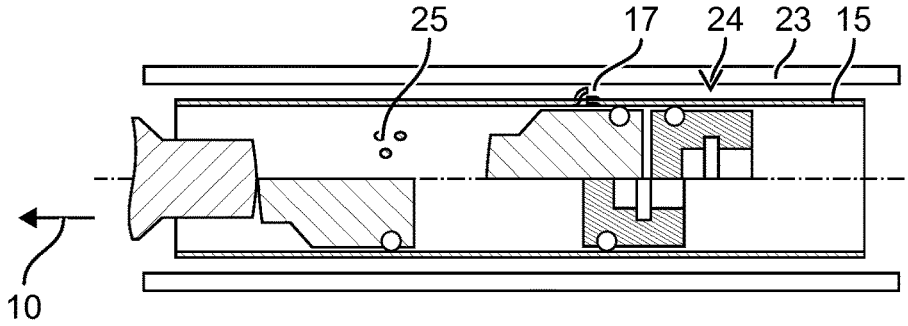
FIG. 2 shows a pneumatic striking mechanism.
Figure 3:
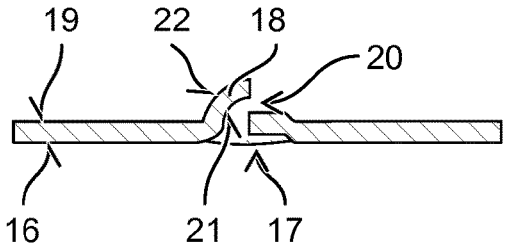
FIG. 3 shows a detail of the guiding tube.

The stiffness of the air spring is designed for an optimal operation of striking mechanism 8. The stiffness is determined by the amount of air in pneumatic chamber 14. During the operation of striking mechanism 8, pneumatic chamber 14 continuously loses an air quantity due to leaks, in particular during the compression of pneumatic chamber 14 at the reversing point of striker 9 facing away from the tool (upper image half of FIG. 2). The loss is compensated for by a small radial compensating opening 17 in guiding tube 15. A diameter of compensating opening 17 is dimensioned in such a way that, while the losses of the air quantity are compensated for, the effect of the air spring during one cycle is simultaneously not influenced. The flow cross section is typically less than 5 $mm^2$.

Compensating opening 17 is covered by a cap 18 on an outside 19 of guiding tube 15. Cap 18 directly and preferably seamlessly abuts outside 19 of guiding tube 15. Cap 18 may have a spherical hollow shape. Illustrated cap 18 is one quarter of a hollow sphere. The radius of curvature of cap 18 largely corresponds to the radius of compensating opening 17.

Cap 18 is open due to a recess 20. An air flow may exit from pneumatic chamber 14 through compensating opening 17. The air flow is guided by an underside 21 of cap 18 until the air flow is able to exit from recess 20 into the surroundings. Underside 21, i.e., the side of cap 18 facing pneumatic chamber 14, preferably changes its inclination with respect to outside 19 from being perpendicular in the vicinity of compensating opening 17 to being parallel to outside 19 at recess 20. The air flow is deflected by 90 degrees in this way, Illustrated recess 20 is an example. Recess 20 may penetrate the surface of cap 18 facing away from the tool, as illustrated, or it may penetrate the surface facing the tool or the surfaces pointing in the circumferential direction. These directions share their tangential orientation with respect to outside 19. The direction of recess 20 points in the orientation of underside 21 at recess 20.

Recess 20 is preferably tangential to outside 19, whereby the air flow is deflected by approximately 90 degrees. In other specific embodiments, the deflection is at least 45 degrees. Recess 20 is largely tangential; a vectorial portion of the radial direction is less than the vectorial portion of the tangential component.

Cap 18 is formed by a bulge of guiding tube 15. Cylindrical inner surface 16 of guiding tube 15 transitions seamlessly into underside 21 of cap 18; similarly, outside 19 transitions into an upper side 22 of cap 18. Underside 21 of cap 18 projects radially beyond cylindrical outside 19 of guiding tube 15. Cap 18 preferably covers at least half of compensating opening 17, preferably entire compensating opening 17.

Guiding tube 15 may be situated coaxially in a carrier tube 23. A channel 24 is formed between guiding tube 15 and carrier tube 23, in which cap 18 is situated. Recess 20 faces channel 24.

The body of striker 9 closes compensating opening 17 during its cyclical movement between the compression point (upper image half in FIG. 2) and the impact point (lower image half in FIG. 2) with respect to pneumatic chamber 14. Compensating opening 17 is closed when pneumatic chamber 14 is greatly compressed, in particular at the compression point, and pneumatic chamber 14 applies a force accelerating in impact direction 10 to striker 9. Compensating opening 17 is open when the pressure in pneumatic chamber 14 is low, in particular when the pressure is below the ambient pressure. Striker 9 does not close compensating opening 17 when striker 9 has traveled more than one third of the distance from the compression point to the impact point.

The position of compensating opening 17 may be optimized with respect to the movement of exciter piston 13. For example, compensating opening 17 is situated near the tool-side reversing point of exciter piston 13 (lower image half in FIG. 2) A distance of compensating opening 17 from the reversing point is typically less than 10% of the lift of exciter piston 13. In the illustrated embodiment, the body of exciter piston 13 does not quite reach compensating opening 17 to close it.

Guiding tube 15 preferably has additional radial openings 25, which are arranged in impact direction 10 with respect to compensating opening 17. These additional (disabling) openings 25 are used to disable an impact during idle strikes. Pneumatic chamber 14 is ventilated via disabling openings 25 when striker 9 is displaced past the impact position in impact direction 10. Disabling openings 25 are dimensioned in such a way that the air quantity periodically moved by exciter piston 13 may flow in or out via disabling openings 25 essentially without resistance. Despite moved exciter piston 13, the pressure in pneumatic chamber 14 does not change or no longer changes sufficiently to move striker 9. To meet the different requirements with respect to the flow resistance, disabling openings 25 are multiple times larger than the generally single compensating opening 17. Multiple disabling openings 25 are advantageously arranged at the same height along working axis 4 to obtain a desirably large flow cross section which is significantly larger than the flow cross section of compensating opening 17.

Disabling openings 25 may have different designs. In the illustrated embodiment, pneumatic chamber 14 overlaps disabling openings 25 only when striker 9 is displaced past the impact point in impact direction 10. Disabling openings 25 are arranged near the impact point, whereby the body of striker 9 continues to close disabling openings 25 against pneumatic chamber 14 until striker 9 is displaced past the impact point. In other embodiments, striker 9 or anvil 11 actuates a sleeve, which releases or closes disabling openings 25. The position of disabling openings 25 may be freely selected in this case.

Exciter piston 13 is connected to electric motor 12 via a drive train 26. Drive train 26 includes a converter 27, which converts the rotational movement of electric motor 12 into a translational movement. Converter 27 illustrated as an example is based on an eccentric wheel driven by electric motor 12 and the connecting rod anchored in exciter piston 13. An alternative design uses a wobble plate, with which the connecting rod engages, instead of an eccentric wheel. Drive train 26 may furthermore include a stepped-down gearing 29 and protective mechanisms, e.g. a friction clutch 30. The mechanical and rigid connection of exciter piston 13 to electric motor 12 ensures a synchronous movement of electric motor 12 and exciter piston 13. Electric motor 12 and drive train 26 are situated in power tool housing 6 of electric hammer 1.

Electric motor 12 is powered via the power supply. Electric motor 12 may be a universal motor, a mechanically commutating electric motor 12 or an electrically commutating electric motor 12. The user may switch electric motor 12 on and off with the aid of an operating switch 31. Operating switch 31 is situated on or near handle 5 and may be preferably actuated by the hand holding handle 5.

What is claimed is:

1. A hand-held power tool comprising:

a tool holder for holding a tool; and a pneumatic striking mechanism for periodically generating impacts on the tool held in the tool holder, the pneumatic striking mechanism including a guiding tube, an exciter piston, a striker, a pneumatic chamber closed by the exciter piston and the strike in the guiding tube and a compensating opening in the guiding tube for ventilating the pneumatic chamber;

the guiding tube having a longitudinal axis defining an axial and a radial direction, and including a cap completely covering the compensating opening in the radial direction on an outside of the guiding tube, and the cap is open in an opening direction tangential to the guiding tube, the cap being fixed with respect to the guide tube.

2. The hand-held power tool as recited in claim 1 wherein the cap is formed by a bulge of the guiding tube.

3. The hand-held power tool as recited in claim 1 wherein the cap is open due to a recess tangential to the guiding tube.

4. The hand-held power tool as recited in claim 3 wherein the cap has exactly one recess.

5. The hand-held power tool as recited in claim 1 wherein an underside of the cap facing the pneumatic chamber transitions integrally without any seams into an inner surface of the guiding tube.

6. The hand-held power tool as recited in claim 1 wherein the cap has a spherical shape.

7. The hand-held power tool as recited in claim 6 wherein a radius of curvature of the cap corresponds to a radius of the compensating opening.

8. The hand-held power tool as recited in claim 1 wherein the cap deflects a flow course from the compensating opening by at least 45 degrees.

9. The hand-held power tool as recited in claim 1 wherein the guiding tube has additional radial openings, and the compensating opening having a smallest flow cross section of the compensating opening and the additional radial openings.

10. The hand-held power tool as recited in claim 1 wherein the compensating opening is situated at a tool-side reversing point of the movement of the exciter piston.

11. The hand-held power tool as recited in claim 1 further comprising a carrier tube, the guiding tube being situated in the carrier tube, the cap being situated in a channel between the carrier tube and the guiding tube.

12. The hand-held power tool as recited in claim 1 further comprising a housing and a handle on an end of the housing facing away from the tool holder.

13. The hand-held power tool as recited in claim 12 further comprising an electric motor in the housing.

14. The hand-held power tool as recited in claim 13 wherein the electric motor is supplied via a power cord.

15. The hand-held power tool as recited in claim 13 further comprising a drive train connecting the electric motor to the exciter piston, the drive train including a rotational to translational movement converter.

16. The hand-held power tool as recited in claim 1 further comprising a chisel, the chisel being the tool held in the tool holder.

17. The hand-held power tool as recited in claim 1 wherein a flow cross-section of the compensation opening is less than 5 $mm^2$.

18. The hand-held power tool as recited in claim 1 wherein the cap deflects a flow course from the compensating opening by 90 degrees.

19. The hand-held power tool as recited in claim 1 wherein the exciter piston has a tool-side reversing point, and a distance of the compensation opening from the tool-side reversing point is less than 10% of a travel length of the exciter piston.

20. The hand-held power tool as recited in claim 1 wherein the guiding tube including the cap is integral and made of a same material.

21. A hand-held power tool comprising:

a tool holder for holding a tool; and a pneumatic striking mechanism for periodically generating impacts on the tool held in the tool holder, the pneumatic striking mechanism including a guiding tube, an exciter piston, a striker, a pneumatic chamber closed by the exciter piston and the strike in the guiding tube and a compensating opening in the guiding tube for ventilating the pneumatic chamber;

the guiding tube including a cap covering the compensating opening on an outside of the guiding tube, and the cap is open in an opening direction tangential to the guiding tube;

wherein an underside of the cap facing the pneumatic chamber transitions integrally without any seams into an inner surface of the guiding tube.

22. A hand-held power tool comprising:

a tool holder for holding a tool; and a pneumatic striking mechanism for periodically generating impacts on the tool held in the tool holder, the pneumatic striking mechanism including a guiding tube, an exciter piston, a striker, a pneumatic chamber closed by the exciter piston and the strike in the guiding tube and a compensating opening in the guiding tube for ventilating the pneumatic chamber;

the guiding tube including a cap covering the compensating opening on an outside of the guiding tube, and the cap is open in an opening direction tangential to the guiding tube;

wherein the guiding tube including the cap is integral and made of a same material.

* * * * *